US005090219A

United States Patent [19]

Schick

[11] Patent Number: 5,090,219

[45] Date of Patent: Feb. 25, 1992

[54] SETTING DEVICE FOR NEEDLE SELECTING APPARATUSES OF A MULTISYSTEM CIRCULAR KNITTING MACHINE

[75] Inventor: Wilfried Schick, Bitz, Fed. Rep. of Germany

[73] Assignee: SIPRA Patententwicklungsund Beteiligungsgesellschaft mbH, Tailfingen, Fed. Rep. of Germany

[21] Appl. No.: 456,581

[22] Filed: Dec. 22, 1989

Related U.S. Application Data

[63] Continuation of Ser. No. 231,534, Aug. 11, 1988, abandoned.

[30] Foreign Application Priority Data

Aug. 14, 1987 [DE] Fed. Rep. of Germany ..... 3727155

[51] Int. Cl.[5] ..... D04B 37/04

[52] U.S. Cl. ..... 66/219; 66/75.2

[58] Field of Search ..... 66/75.2, 218, 219, 223, 66/222

[56] References Cited

U.S. PATENT DOCUMENTS

| | | | |
|---|---|---|---|
| 3,585,829 | 6/1971 | Farmer | 66/219 |
| 3,807,197 | 4/1974 | Plath | 66/219 |
| 3,854,304 | 12/1974 | Hamma | 66/219 |
| 3,983,370 | 9/1976 | Caspi et al. | 66/219 X |
| 4,311,029 | 1/1982 | Sommer et al. | 66/75.2 |
| 4,541,254 | 9/1985 | Schindele et al. | 66/223 |

FOREIGN PATENT DOCUMENTS

| | | | |
|---|---|---|---|
| 642195 | 7/1962 | Italy | 66/222 |
| 61-10945 | 1/1986 | Japan | 66/75.2 |
| 2076024 | 11/1981 | United Kingdom | 66/75.2 |

*Primary Examiner*—Werner H. Schroeder
*Assistant Examiner*—John J. Calvert
*Attorney, Agent, or Firm*—Michael J. Striker

[57] ABSTRACT

A setting device for needle selection devices of a multisystem circular knitting machine includes a portable displacement unit connectable to individual needle selecting apparatuses of the systems of the machine and a separate programmable electric control unit connected to the setting unit by a cable. The displacement unit has a setting member displaceable against selecting blades of a needle selecting apparatus and being activated according to a program by a solenoid. The displacement unit is provided with a display and control buttons for entering and displaying a code number of a system to be set. The control pulses for the solenoid and for the movement of the setting member are delivered according to a program by the separate electric control unit.

10 Claims, 5 Drawing Sheets

SETTING DEVICE FOR NEEDLE SELECTING APPARATUSES OF A MULTISYSTEM CIRCULAR KNITTING MACHINE

This application is a continuation of application Ser. No. 231,534, filed Aug. 11, 1988, now abandoned.

BACKGROUND OF THE INVENTION

The present invention relates to a setting device for needle selecting devices, particularly for selecting apparatuses of a multisystem circular knitting machine wherein each needle selecting apparatus of a system includes at least one set of superposed selection blades movable between a rest position and a working position, and a common locking member which locks the entire set of blades in their adjusted positions in which they act on control bars of swing selectors on the needle cylinder of the knitting machine which in turn control the needles into their operating positions.

The needle selecting devices of this type provide selection of individual needles for knitting a pattern of a limited size whereby the pattern is cyclically repeated after each revolution of the machine. The pattern is fixedly set and retained in the respective needle selecting apparatuses. The device enables the production of patterns of small periodicity or limited texture combinations. The height of the pattern is limited by the number of systems of the machine and the width of the pattern is limited by the number of control butts of the selector bars. Knitted fabrics with small patterns of this kind, depending on their field of use and fashion, are in increased demand. A substantial factor affecting the demand is the provision of a circular knitting machine which is cost effective and reliable in operation and which in contrast to machines having electronically controlled pattern selectors are provided with needle selecting apparatuses which are simpler in design. Hitherto, such simple needle selecting apparatuses have been set according to a desired pattern by hand. A setting or resetting is always necessary when a fabric having a different pattern or texture is to be produced. The setting of conventional needle selecting apparatus requires long setting times leading to protracted idling of the machine. It makes no difference if the selecting apparatuses are reset directly on the machine or if the apparatuses are replaced by a new set of preset apparatuses. In both instances considerable setting times are necessary. In the case when the selecting apparatuses are exchanged the cost of the duplicated equipment and the corresponding maintenance and storage costs multiply and also a considerable installation and adjustment expenditures result.

It is known to set such needle selecting apparatuses by means of pattern cards, pattern combs or loose selecting blades. However, such pattern cards, combs and the like must be first provided with the requisite cutouts and must be installed on the selecting apparatus when needed. The setting combs have the disadvantage, apart from their susceptibility to displacement, that they become completely useless when the particular pattern is no longer needed. In addition, even if a single mistake occurs in the production of a comb, the latter is no longer applicable. Also, when using the prepared pattern determining elements the setting time for the selecting apparatuses is not substantially shorter in comparison with the installation work.

Attempts have been made to store several patterns on a drum. This method leads to expensive needle selecting apparatuses and the pattern storage is limited to a small number of patterns. In circular knitting machines having a large number of systems the application of voluminous storage drums due to the minute distance between the systems is not possible. The storage drums are usually complemented with pins or pattern combs and are also prepared manually with concomitant high preparation times.

The needle selecting apparatuses are always set or reset during the standstill of the machine or apart of the machine. This process cannot be compared with that for the needle selection devices for large area Jacquard patterns where the switchovers are carried out in running machine and the selection in the machine cycles is different.

SUMMARY OF THE INVENTION

An object of this invention is to provide a setting device for the needle selecting apparatuses of the aforementioned kind which allows a fast and efficient setting of the selecting apparatuses for a large number of different knitting patterns.

Another object of this invention is to provide such a setting device which can be applied to needle selecting apparatuses of different designs.

In keeping with these objects and others which will become apparent hereafter, one feature of this invention resides in the provision of a transferable, displacement unit including solenoid operated displacement means arranged opposite the entire set of the selector blades of a needle selecting apparatus to displace individual blades into their working positions when actuated, and a programmable electric control device for delivering according to a program actuation signals to a solenoid of the displacement means. In the preferred embodiment, the separate displacement unit is manually attached to the needle selecting apparatus of a system of the machine by means of a releasable snap connection, and the unit is provided with control elements for alining the displacement means with the selection blades of the apparatus and for releasing the setting process. The displacement unit is further provided with a display for indicating at least the number of the system of the machine in which the needle selection is being set, and is connected by a cable with the separate programmable electronic control device.

The setting device designed according to this invention does not allow any selection blade setting and thus any pattern changes in a running machine. However, it facilitates the response to changing use and fashion conditions according to which a circular knitting machine can be adjusted to produce at a high efficiency and at a low periodicity predetermined individual patterns. The setting device of this invention achieves the above mentioned objectives without regard to particular structures of the circular knitting machines. A separate electronic programmable control device is employed for achieving a simple and fast setting of the needle selecting apparatuses according to a pattern program stored in a memory. The pattern can be easily reproduced. The setting device can be easily matched to different commercially available needle selecting apparatuses for circular knitting machines. The displacement unit in connection with the separate electronic control device allows a simple and reliable resetting of a multisystem circular knitting machine to a knitting pattern selected from a large number of stored patterns. The knitting machine by itself needs only to be equipped with the sets of parallel arranged selection blades. The displacement unit of this invention together with its programmable control device form mobile units which can be used for servicing an entire aggregate of knitting machines.

The displacement unit of the setting device is constructed such that for each selection blade of a selecting apparatus, a separate electromagnetic displacement member is provided and electrically connected with the programmable control device. Such an embodiment of the setting device permits a simultaneous setting of all selection blades in the needle selecting apparatus but the large number of electromagnetic actuators makes the electrical circuit complex in structure and also the electrical control circuit for controlling the pattern programs is more expensive. In the preferred embodiment of this invention, the means for displacing respective selecting blades of a needle selecting apparatus includes a single electromagnetic actuator and a single setting member driven by a stepping motor to move from one selecting blade to another one. A slightly longer setting time for a set of selecting blades is counterbalanced by a simpler construction of the setting and controlling circuits. With advantage, the setting member is in the form of a spring biased plunger mounted on a slide carriage which is driven by the stepping motor from one selecting blade to another and selectively operated by a single solenoid via a tilting strip extending along an entire set of selecting blades. In needle selecting devices which include two sets of selecting blades for each system of the machine the sliding carriage supports two actuation plungers assigned to respective sets of blades. In order to select between the knitting, tucking and non-knitting modes of operation there is provided a separate tilting or swing strip actuated by a separate solenoid for each setting plunger.

An important advantage of the setting device according to this invention is the provision of controls and displays by means of which an operator releases, controls and sets the operation of the entire setting device such that the desired data for each system of the machine instantly set the corresponding selection blades and that no system is inadvertently omitted. In cooperation with the separate programmable control device there result many sided controlling possibilities. There can be provided a keyboard for entering the system number to be set and the direction of the stepwise setting process. The programmable control unit which is connected with the displacement unit by a multiple conductor cable includes a storage device in which data for a plurality of knitting patterns are stored. The storage device may include a fixed memory, a magnetic tape memory or a magnetic disc memory in which data of a pattern to be produced is written and from which it is read out or if desired erased.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
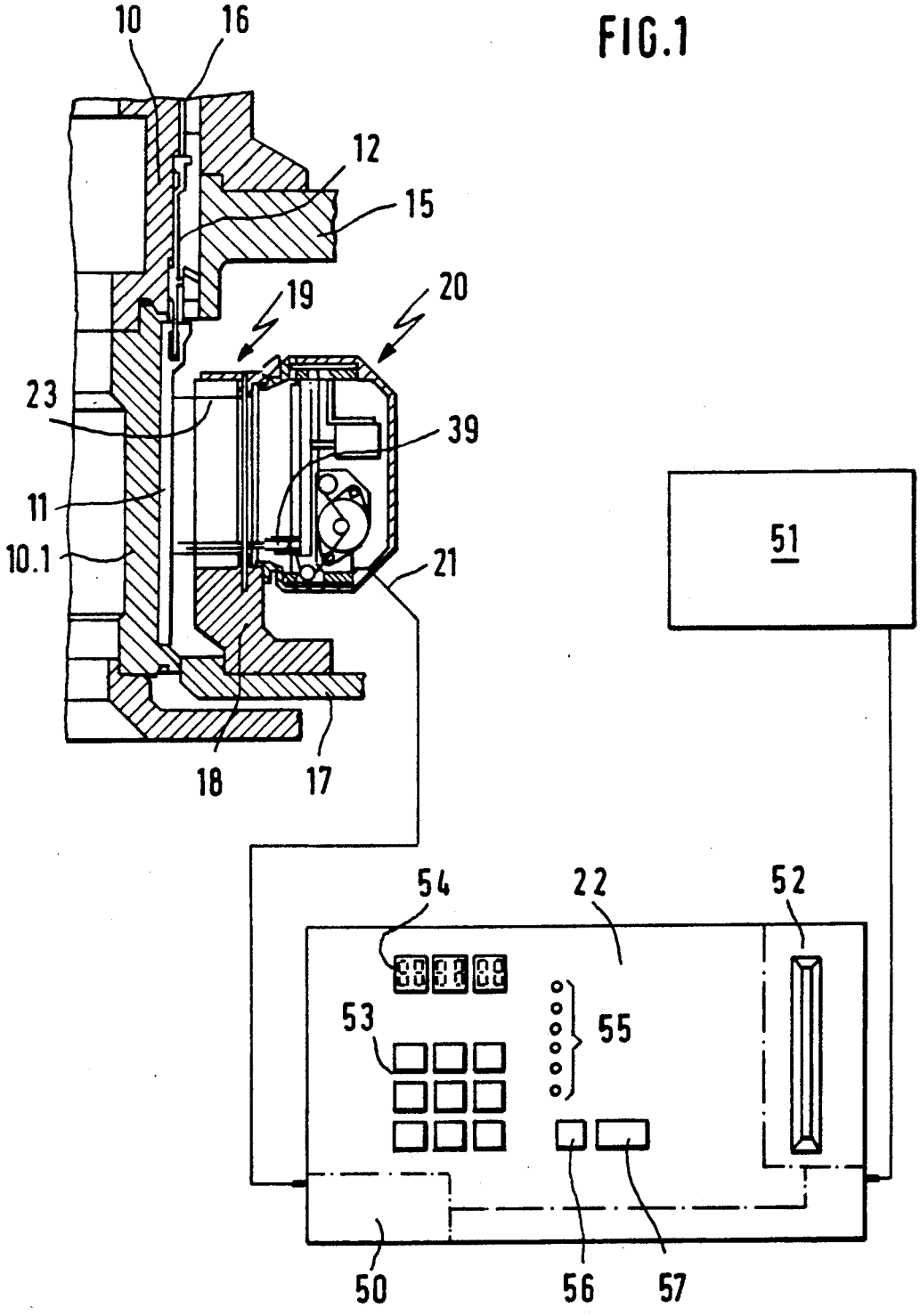
FIG. 1 shows schematically the layout of a setting device of this invention assembled of a separate displacement unit installed in a needle selecting apparatus of a circular knitting machine and a separate programmable electronic control unit.
Figure 2:
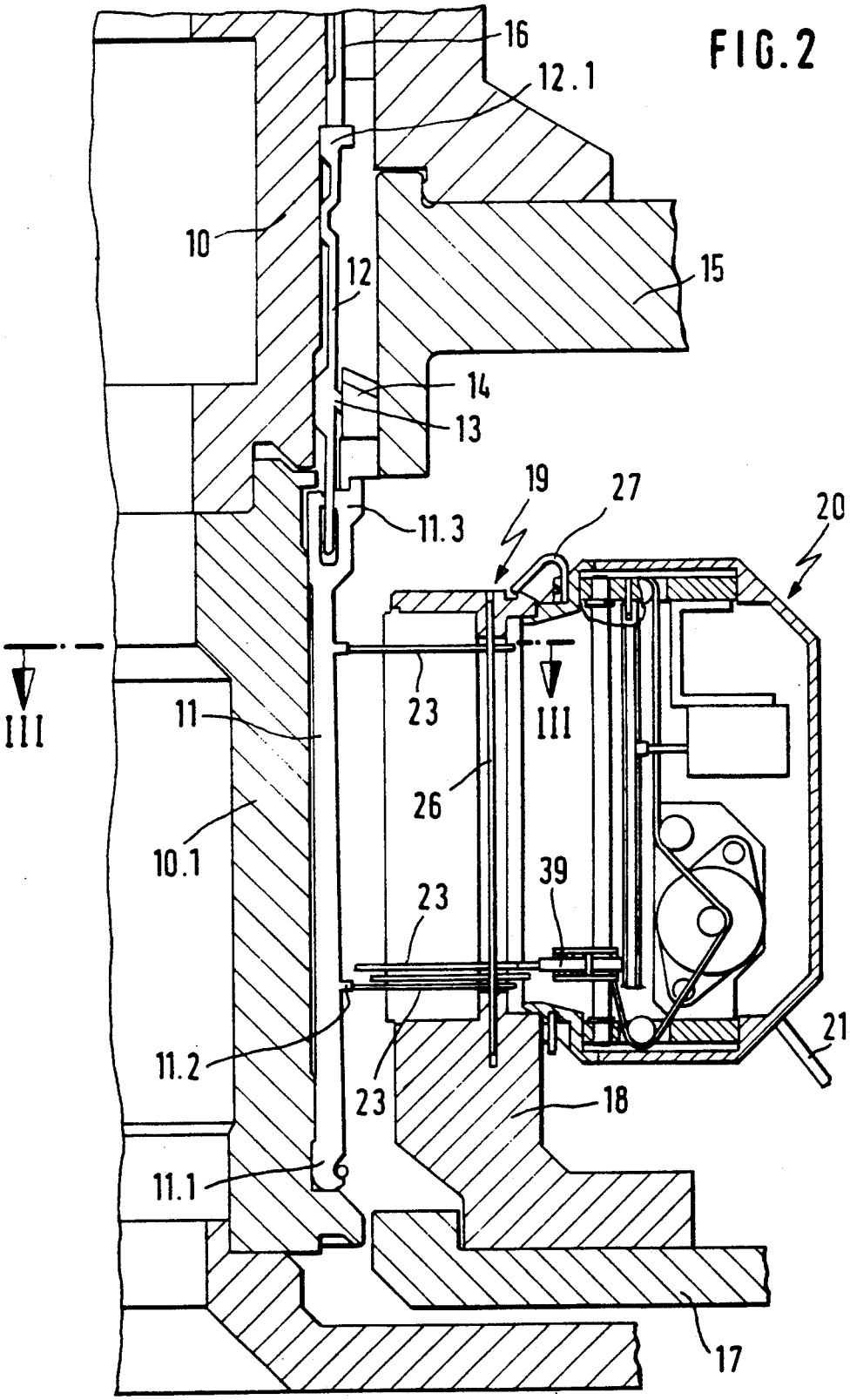
FIG. 2 shows on an enlarged scale and displacement unit of FIG. 1 installed on a needle selecting apparatus of the circular knitting machine.

Referring firstly to FIGS. 1 and 2 there is illustrated in a radial section a multisystem circular knitting machine including a needle cylinder 10. Lower part 10.1 of the needle cylinder supports a plurality of selector bars 11 each being tiltable about its lower end 11.1. The other end of each selector bar 11 is in the form of a forked head 11.3 into which the tail of an assigned needle rising jack 12 projects. Each jack 12 is provided with a control butt 13 for engaging a cam track 14 which controls its vertical position. The cam tracks 14 for controlling the longitudinal movement of the needle shifting jacks 12 are mounted in a stationary cam ring 15. The head parts 12.1 of respective jacks 12 are in contact with the lower end of respective knitting needles 16. A stationary support ring 17 of the knitting machine supports base parts 18 of the needle selecting apparatuses 19 assigned to respective systems of the machine.

The needle selecting apparatus 19 visible in FIGS. 1 and 2 is illustrated in connection with a blade setting device of the invention which includes a transferable displacement unit 20 which is connected via a multiconductor cable 21 to a separate control unit 22 (FIG. 1).

Figure 3:
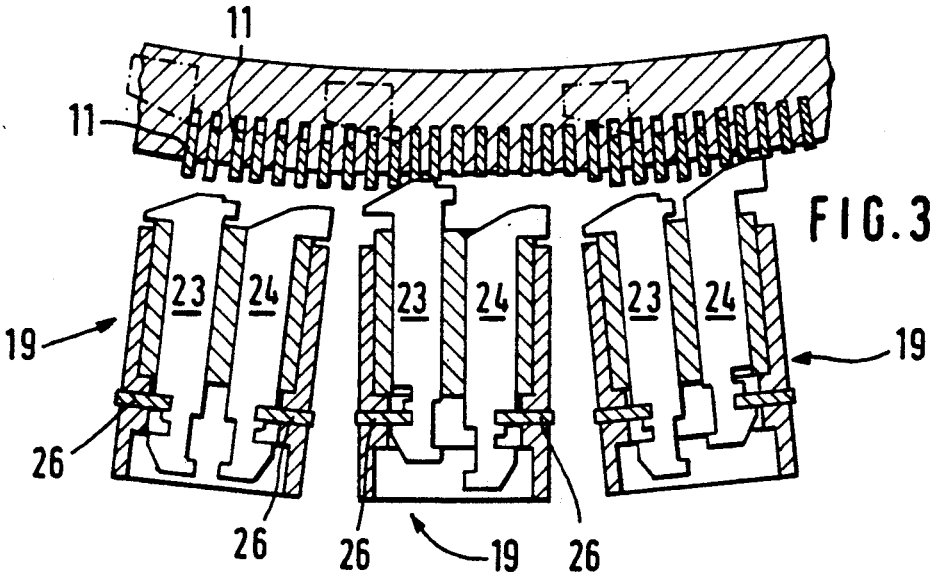
FIG. 3 is a horizontal section taken along the line III—III of FIG. 2, and showing a plurality of needle selecting apparatuses pertaining to corresponding systems on the needle cylinder of the circular knitting machine.
Figure 4:
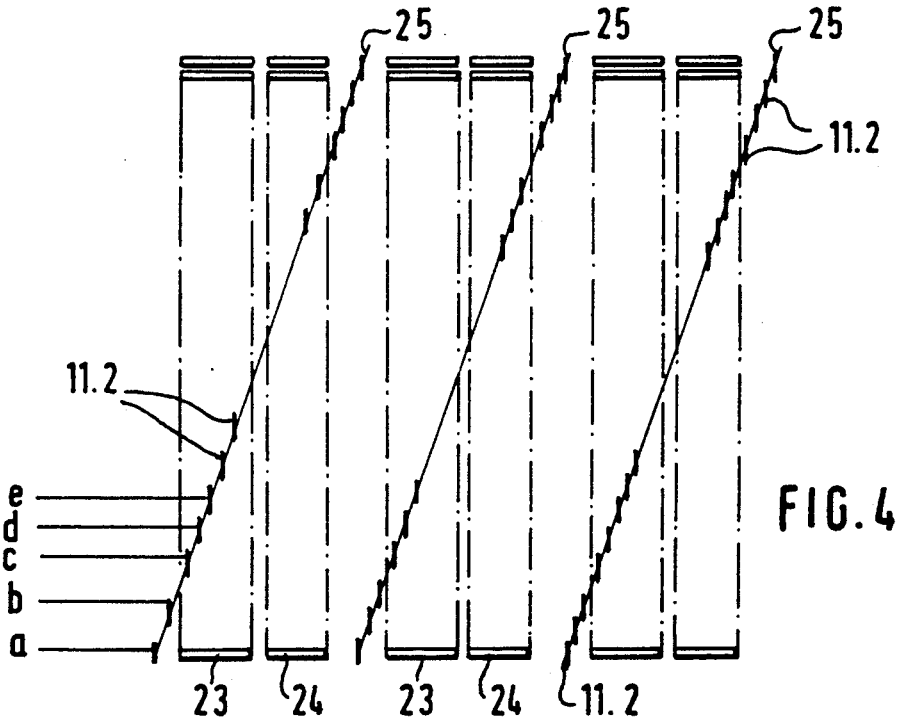
FIG. 4 is a section taken in axial direction of the circumferential portion of the needle cylinder of FIG. 3.
Figure 5:
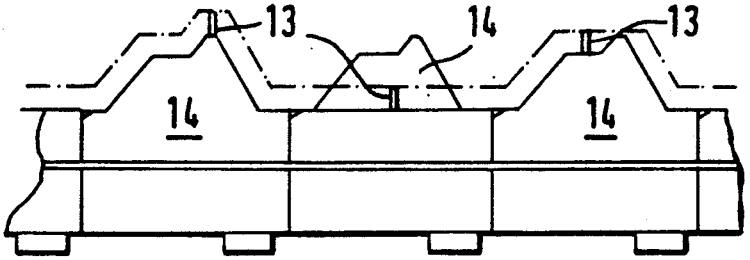
FIG. 5 is a schematic elevational view of a portion of a cam curve for selecting the three possible operating positions of the knitting needles of each of the systems of the circular knitting machine set by the two sets of selecting blades.

Each of the knitting systems which in a conventional manner are uniformly distributed on the circumference of the circular knitting machine, is provided with its own fixedly installed needle selecting apparatus 19. Referring to FIG. 3, each selecting apparatus 19 includes two parallel sets of superposed selecting blades 23 and 24. As indicated in FIG. 4, the control butts 11.2 of neighboring selectors 11 in each system are arranged at different levels a, b, c, d, e and so on, whereby each of the selecting blades 23 and 24 is in alignment with one of the levels of the control butts in a system. The different positions of the control butts 11.2 are aligned along inclined lines 25 extending on corresponding circumferential portions of the needle cylinder. The control butts can be also aligned along roof-shaped circumferential lines as disclosed for example in FIG. 6 of of the German publication DE-OS 19 53 180 corresponding to the U.S. Pat. No. 3,641,787. All selecting blades 23 and 24 can be individually set in radial direction relative to the needle cylinder part 10.1 between a rest position illustrated at the left side of FIG. 3 and a working position indicated in the intermediate and right-hand side of FIG. 3. In either position all of the selecting blades are lockable at the same time by common locking webs 26. In the working position the selecting blades 23 and 24 engage the assigned control butts 11.2 and swing the corresponding selector bars 11 and lifting jacks 12 into positions visible in FIG. 2. If the two sets of selecting blades 23 and 24 remain in their rest position shown at the left side in FIG. 3 the selector bars 11 are not affected. In this case, the needle lifting jacks 12 are in positions in which their control butts 13 engage the cam tracks 14 and is lifted to bring the assigned needles 16 into their knitting positions as illustrated at the left side in FIG. 5. If in a needle selecting apparatus 19 a selecting blade 23 is set into its working position and the neighboring selecting blade 24 is in its rest position then during rotation of the needle cylinder the corresponding selector bars 11 of a system are alternately brought into and out of the actuated position illustrated in FIG. 2 and accordingly the corresponding jack 12 are engaged and disengaged by the cam tracks 14. If the control butt 13 of jacks 12 is in the position shown in FIG. 2, the cam track 14 is out of its reach and the corresponding needle 16 is in its "no knitting" operational mode. This so-called circulating position of the control butt 13 of the jack 12 is indicated in the intermediate part of FIG. 5.

If however two neighboring selecting blades 23 and 24 of the two sets of blades the blade 23 is held in its rest position and the blade 24 is displaced into its working position then as indicated in the right hand selecting apparatus 19 in FIG. 3, the corresponding selector bars 11 are first moved into a position in which the control butt 13 of the corresponding jack 12 is moved longitudinally in the so-called tucking or pull-up position, and then is brought out of engagement of its cam part 14. The corresponding needle 16 is brought in its tucking or pull position illustrated at the right hand side in FIG. 5.

The adjustment of the individual selecting blades 23 and 24 in the two blade sets of a needle selecting apparatus 19 is carried out by means of the transferable displacement unit 20 which according to FIGS. 1 and 2 is insertable in apparatuses 19 and locked in its operating position by means of a snap spring 27. The construction of the displacement unit 20 of this invention is explained with reference to FIGS. 6 through 8. The unit includes a housing 28, which is open at its side 29 facing the needle selecting apparatus 19. Within the housing 28 there are arranged side by side two stationary solenoids 30 and 31 each acting with its armature 30.1 and 31.1 on one of two swing strips 32 and 33. Each swing strips extends over the entire height of the housing 28 and is supported for rotation about an axis 34 or 35. The housing 28 further includes two guiding rods 36 and 37 arranged between the swing strips and the open side 29 of the housing and extending parallel to the axes 34 and 35. The guiding rods support for sliding movement a slide carriage 38 which supports two spring-biased plungers 39 and 40 arranged side by side opposite the respective sets of superposed selecting blades 23 and 24. In the rest position, the biasing spring urges its plunger away from the selecting blades as indicated in FIG. 7 a plunger 40.

Figure 6:
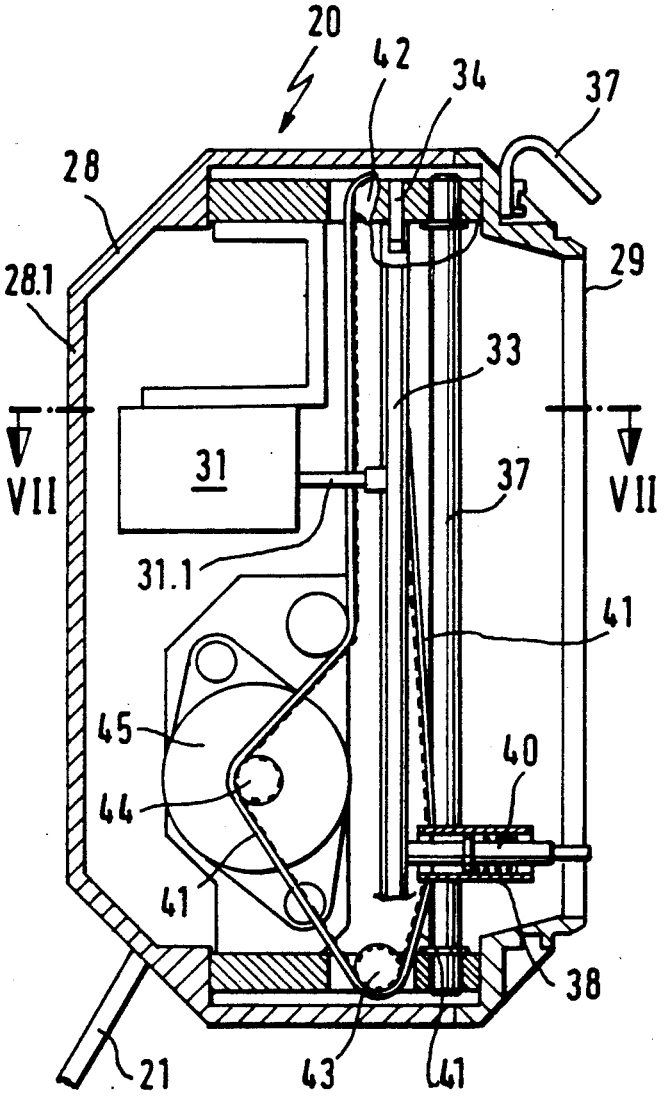
FIG. 6 is a side view of the needle displacement unit of the invention shown in a position turned by 180° with respect to the position shown in FIGS. 1 and 2.
Figure 7:
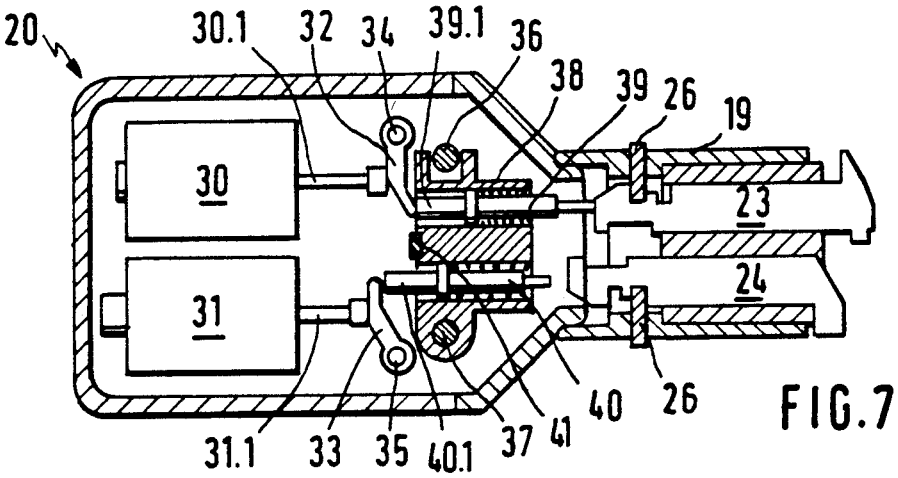
FIG. 7 is a sectional top view taken along the line VII—VII in FIG. 6 of the displacement unit of this invention.

Referring to FIG. 6, the sliding carriage 38 is connected to the ends of a toothed belt 41 which is guided via an upper deviation roll 42 and a lower deviation roll 43 into engagement with a pinion 44 secured to the shaft of a stepping motor 45. The stepping motor is fixedly arranged in the housing 28 and is powered from the unit 22. With each step of the motor 45 the sliding carriage 38 is displaced on the guiding rods 36 and 37 by a distance corresponding to the spacing between the levels a, b, c, and so on of the control butts 11.2 of the selector bars 11. During the stepwise movement of the sliding carriage 38, the inner end 39.1 of the plunger 39 slides along the swing strip 32 whereas the inner end 40.1 of the other plunger 40 slides along the other swing strip 33. Accordingly, in any position of the carriage 38 both plungers 39 and 40 engage the swing strips 32 and 33. The opposite side of each swing strip is in sliding contact with the armature of solenoids 30 and 31 which when actuated, displaces an assigned swing strip from its rest position into its activated position corresponding respectively to the positions of strips 33 and 34 in FIG. 7. In the activated position of the swing strip the corresponding plunger, for example plunger 39 in FIG. 7, is displaced against the force of its biasing spring to a position in which it displaces a juxtaposed selecting blade 23 into its working position. Similarly, when the plunger 40 is pressed forwards, the selecting blade 24 is brought into its working position.

Figure 8:
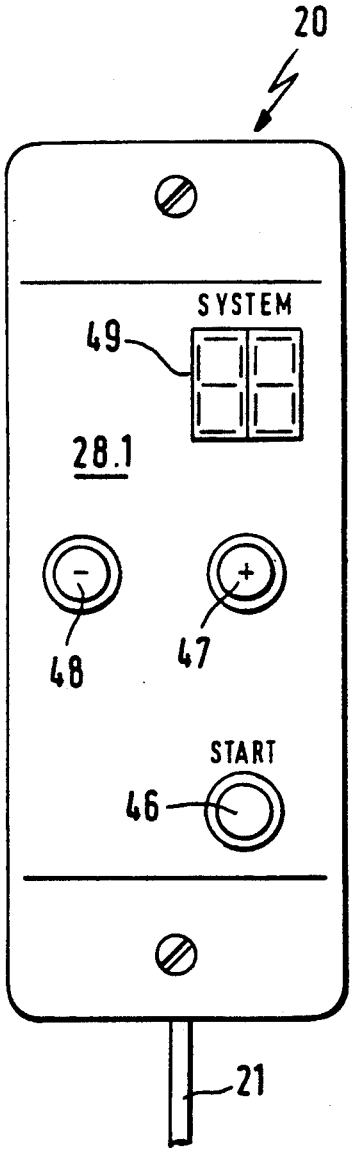
FIG. 8 is an elevational view of the rear side of the displacement unit of FIG. 6.

The programmable control with 22 illustrated in FIG. 1 is connected via the multiconductor cable 21 with the setting unit 20 to control not only its stepping motor 45 and its two solenoids 30 and 31, but also electrical switching elements and a display device provided on the rear wall 28.1 of the housing as illustrated in FIG. 8. The electrical switching elements include a start button 46, a setting button 47, and a resetting button 43, the display device includes a digital light emitting diode display 49. By means of two buttons 47 and 48 the number of the system of the circular knitting machine whose selecting blades are to be set, is entered or reset by repeated actuation. The entered system number is displayed in the digital light emitting diode display 49. Upon the entry of the system number and after the installation of the displacement unit 20 of this invention on an apparatus 19, the blade setting process in the corresponding system of the circular knitting machine is released by pressing the start button 46. Sliding carriage 38 starts moving from its lower starting position into which it returns after completion of the setting operation, to its upper position opposite an uppermost selecting blade. The stepping motor 45 stops at respective vertical positions a, b, c, etc. As mentioned before, each vertical position corresponds to a change in the knitting pattern processed by the circular knitting machine. The solenoids 30 and/or 31 are activated or non-activated according to a program and the corresponding selecting blades 23 and/or 24 are shifted either into their working positions or remain in their rest positions. Of course, prior to the commencement of the setting process all selecting blades in both sets are released by releasing the locking webs 26 and all blades are brought for example by hand into their rest positions. After the completion of the setting process; locking webs 26 are returned into their locking position to secure the new setting of the blades and the setting unit 20 is removed from the selecting apparatus 19 and installed on the apparatus of that system whose number had been entered by means of the buttons 47 and 48 and indicated on the display 49. Before pressing the start button, 46, the selecting blades 23 and 24 of the new system are again released and brought into their rest positions by releasing the locking webs 26 and after finishing the setting process the new position of the blades is secured by resetting the locking blades.

Figure 9:
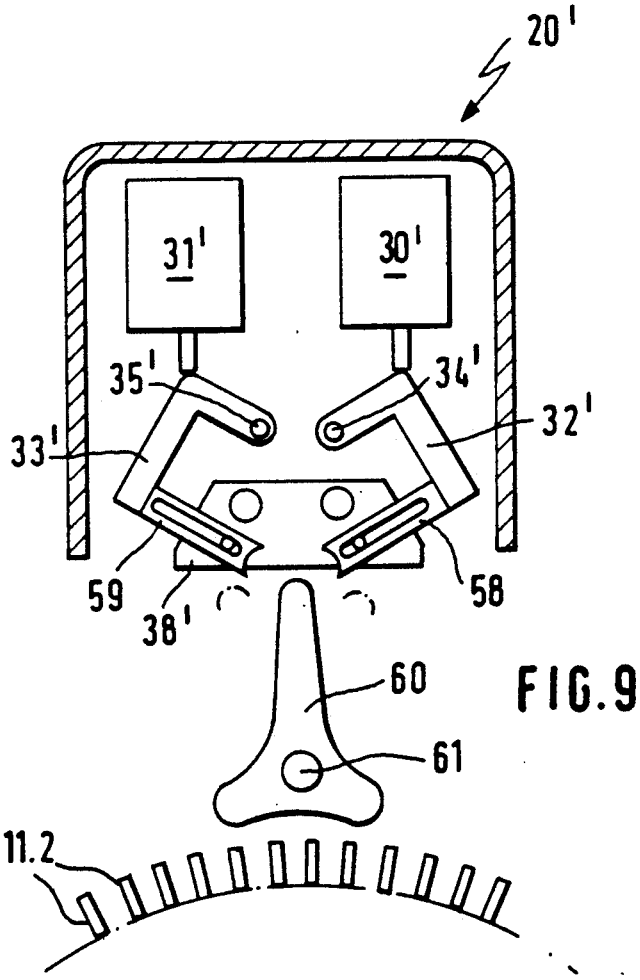
FIG. 9 is a top view of a modification of the displacement unit of FIG. 7.

The control pulses for the stepping motor 45 and for the two solenoids 30 and 31 in the setting unit 20 are supplied via the multiconductor cable 21 from a programmed memory 50 of a programmable control unit 22 shown in FIG. 1. The programmable memory 50 may include either a fixed memory 51 which is a part of a pattern storing device or via a disc drive 52 reading a magnetic diskette on which a plurality of knitting patterns are stored. The code number of the knitting pattern is selected on a keyboard 53 of the control unit 22 and is indicated on a digital display 54 on the unit 22. The digital display 54 can serve also for indicating the system number being processed and the momentary vertical level a, b, c, and so on of the sliding carriage 38 in the setting unit 20. The input keyboard 53 can serve also for the selection of desired programs, such as for example the writing of pattern data into the program memory 50, the reading out of the data from the program memory 50, or the erasing of such data from the memory. FIG. 1 also illustrates indicator lamps 55 for indicating a set program, and additional keys 56 and 57 serving for example for the switch-over of the modes of indications of the display 54. The setting unit 20 of this invention is readily adjustable to different configurations of the selecting blades and accordingly it can be adjusted to different types of the needle selecting devices. For example, FIG. 9 shows schematically a blade setting device 20' serving for setting selecting blades 60 constructed in the form of rotary shifters as disclosed in the DE-PS 32 22 744 corresponding to the U.S. Pat. No. 4,541,254. The locking of the selecting blades 60 can be performed by elements which are similar to the block 23 and the sops 24, 25 of this patent, which is incorporated here by reference. In this embodiment, the solenoids 30' and 31' act on oblique plungers 58 and 59 guided on the stepwise displaceable sliding carriage 38' via angular swing strips 32', 33' rotatable about respective axes 34' and 35'. The plungers 58 and 59 selectively rotate the rotatable selecting blades 60 about their axes 61 to move the blades in one or the other direction of rotation.

While the invention has been illustrated and described as embodied in specific examples of the blade setting, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A setting device for use in connection with a multisystem circular knitting machine to selectively displace between a rest position and a working position pattern selecting blades of needle selecting apparatuses in respective systems of the machine, the machine including a plurality of selector bars coupled to jacks for controlling operative positions of needles of the machine, each selector bar having a control butt arranged at a different level and each needle selecting apparatus including at least one set of said selection blades arranged one above the other at the levels of respective control butts and means for locking said blades in either position thereof whereby during operation of the machine the blades which are locked in their working position engage the assigned control butts, the setting device comprising a removable displacement unit connected during the standstill of the machine to a needle selecting apparatus, the displacement unit including solenoid operated displacement means arranged opposite the entire set of the selecting blades to displace individual blades into a desired position when actuated, and a separate programmable electric control unit connected by a cable to said displacement unit to deliver according to a program actuation signals to said solenoid operated displacement means.

2. A setting device as defined in claim 1, wherein said displacement unit is connectable to said needle selecting apparatus of each system of the machine, and includes an electromagnetically activated setting member for selectively engaging said selection blades.

3. A setting device as defined in claim 1, wherein each needle selecting apparatus includes superposed rotary selection blades, said displacement unit including sliding carriage supporting a pair of setting members for engaging said selecting blades, a stepping motor for moving the carriage to the levels of respective blades and a single pair of electromagnetic actuators for activating said setting members on the sliding carriage.

4. A setting device as defined in claim 2, wherein a single solenoid operated setting member is provided for entering set of selection blades, said setting member being advanced by a stepping motor from one selection blade to another one.

5. A setting device as defined in claim 4, wherein each needle selecting apparatus includes an additional set of superposed needle selection blades arranged parallel to the first mentioned set, said displacement unit including a carriage driven by said stepping motor from one blade in each set to another one, a pair of spring biased plungers supported side by side on said carriage, a pair of swing strips each engaging at one side thereof an end of the assigned plunger, and a pair of solenoids whose armatures engage the opposite side of assigned swing strips to displace the corresponding plunger into engagement with a selection blade when activated.

6. A setting device as defined in claim 5, wherein said sliding carriage is coupled to said stepping motor via a toothed belt.

7. A setting device as defined in claim 5, wherein said displacement unit includes a display device and switching elements for entering a code number of a system of the circular knitting machine to be set and an elastic circuit for displaying the entered number on said display device.

8. A setting device as defined in claim 5, wherein said programmable electric control unit is connected to said displacement unit by a multiconductor cable, said control unit including means for storing a program for operating said displacement unit and a memory for storing data corresponding to different knitting patterns according to which the needle selecting apparatus is to be set.

9. A setting device as defined in claim 8, wherein said programmable control unit includes a keyboard for entering code data for selecting a desired program and a desired knitting pattern, and display means for indicating an entered program and a knitting pattern retrieved from the memory and the position of the sliding carriage in said displacement unit.

10. A setting device as defined in claim 2, comprising a plurality of said electromagnetically activated setting members, each setting member being arranged for setting an assigned selection blade of said needle selecting apparatus; and means for connecting the setting members to said programmable electric control unit.

* * * * *